US005845791A

United States Patent [19]

Kawolics

[11] Patent Number: 5,845,791

[45] Date of Patent: Dec. 8, 1998

[54] DEVICE FOR STORAGE AND DISPENSING OF ARTICLES

[75] Inventor: Raymond P. Kawolics, Solon, Ohio

[73] Assignee: The Meyer Company, Cleveland, Ohio

[21] Appl. No.: 837,052

[22] Filed: Apr. 11, 1997

[51] Int. Cl.[6] ..... A47F 5/00

[52] U.S. Cl. ..... 211/49.1; 211/50; 211/59.2; 312/42; 312/60

[58] Field of Search ..... 211/49.1, 59.2, 211/50, 184; 312/42, 43, 50, 60, 61

[56] References Cited

U.S. PATENT DOCUMENTS

| | | |
|---|---|---|
| 337,394 | 3/1886 | Goodale . |
| 1,061,812 | 5/1913 | Brandt . |
| 1,156,140 | 10/1915 | Hair . |
| 1,366,275 | 1/1921 | Payzant . |
| 2,728,623 | 12/1955 | Foerstner . |
| 2,889,018 | 7/1959 | Swan . |
| 3,168,229 | 2/1965 | Heifetz . |
| 3,505,709 | 4/1970 | Tirone . |
| 3,851,938 | 12/1974 | McCowan et al. . |
| 4,250,927 | 2/1981 | Newburg . |
| 4,305,512 | 12/1981 | Mackenzie . |
| 4,400,858 | 8/1983 | Goiffon et al. . |
| 4,503,982 | 3/1985 | Lewis . |
| 4,643,334 | 2/1987 | Steele . |
| 4,712,708 | 12/1987 | Taguchi . |
| 4,842,149 | 6/1989 | Vining . |
| 5,147,119 | 9/1992 | Harris . |

*Primary Examiner*—Robert W. Gibson, Jr.
*Attorney, Agent, or Firm*—Fay, Sharpe, Beall, Fagan, Minnich & McKee

[57] ABSTRACT

A device for storing and dispensing a plurality of articles, said device being comprised of an elongated body shaped to contain said plurality of articles in a stacked arrangement, said elongated body having a longitudinal axis with a predominantly vertical orientation, at least one wall of said elongated body including an aperture extending along a substantial portion of a length of said body, said aperture being sized to allow removable of at least one of said articles through said aperture, at least one removable clip being positioned inside said elongated body to provide separation of at least two groups of said articles.

15 Claims, 3 Drawing Sheets

DEVICE FOR STORAGE AND DISPENSING OF ARTICLES

BACKGROUND OF THE INVENTION

1. Field of the Invention

This invention relates to a device for storage and dispensing of articles. More particularly, this invention relates to a device that stores a variety of differently sized articles in distinct areas, the size of the areas being readily adjustable by moveable dividers.

The inventive device is particularly well-suited to be used as a storage and dispensing apparatus for drink cup lids and the like. Throughout the specification, numerous references will be made to the use of the device as a drink cup lid dispenser, and certain drink cup lid dispensers will be discussed in the Description of the Art. However, it should be realized that the invention can be used in the storage and dispensing of a variety of other articles as well as drink cup lids.

2. Description of the Art

Many types of dispensers are in use today, each generally constructed to dispense a particular article. In today's highly competitive retail market, such dispensers must conveniently and quickly dispense articles into the hands of the store personnel or to the ultimate consumer. Drink cups represent one article which is frequently dispensed to allow a consumer to independently fill the cup with his or her beverage of choice. Coincidentally with filling of the drink cup, the customer requires a lid to be used in conjunction with the drink cup. Accordingly, cup lid dispensers are also frequently used in association with self-service beverage dispensing systems.

One example of a drink cup lid dispenser is provided by U.S. Pat. No. 4,643,334, herein incorporated by reference. In this dispenser, lids are sequentially dispensed from the lower portion of an elongated storage chamber. One shortcoming of this device is that only the lower most lid is accessible to the consumer. Since most beverage dispensing systems offer different sizes of drink cups, differently sized drink cup lids must be provided. A system which dispenses only the lower most lid can inherently only dispense a single sized lid at any given moment. Accordingly, multiple dispensers must be used, adding cost to the overall system and eliminating valuable retail space. Along these lines, a divided dispenser has been previously available to those in the art to provide a plurality of storage areas in a single elongated chamber. The variety of storage areas allows different sized drink cup lids to be stored and accessible. However, the divided dispenser is only available with metal partitions soldered, braised or welded contiguously to the inner chamber of the elongated dispenser. Accordingly, the system is not adjustable to accommodate changes in stocking patterns for large, medium and small sized lids. Since many retail establishments are not able to predict in advance the specific volume requirements for each drink cup lid size, a drink dispensing system is often provided with too large an area for a particularly sized lid. In fact, since customer habits often change over time, it would be desirable to allow adjustment to the distinct storage areas to accommodate changes in popularity of drink cup lid sizes. In addition, the manufacturing step of permanently fixing each partition adds significant cost to the overall drink cup lid dispensing system.

SUMMARY OF THE INVENTION

Accordingly, it is a primary object of this invention to provide a new and improved storage and dispensing device.

It is a particular advantage of this invention to provide a new and improved device that provides storage and accessibility to a variety of differently sized articles.

A still further advantage of this invention is to provide a storage device that is easily adjustable to allow storage and access to different quantities of the differently sized articles.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the device of this invention comprises an elongated body shaped to house a plurality of articles in a stacked arrangement. The elongated body includes an open top end, a closed bottom end, and at least one wall including an aperture extending along a substantial portion of the length of the body to provide access to a stacked arrangement of articles. Preferably, the aperture is sized to allow removal of at least one of said articles at a time through the aperture yet to retain the remaining of the articles in a fixed position. At least one removable clip is positioned inside of the elongated body to provide separation of at least two groups of the articles. The clip is preferably comprised of a material or of a shape which allows distortion of its resting shape, facilitating removal of the clip resilient return to the resting shape. Preferably, the material provides sufficient strength to engage the elongated body and support a stacked arrangement of a plurality of the articles. Generally, the separated two groups will represent two different sizes of the articles.

Preferably, the body includes a plurality of notches aligned to accommodate portions of the clip and the clip includes edges or corners which in a resting state, mate with the holes or notches in the walls of the elongated body.

In a preferred form of the invention, the cross-sectional edge of the elongated body is generally similar to that of the store article. More preferably the device is cylindrical and designed to store and dispense lids for drink cups.

BRIEF DESCRIPTION OF THE DRAWINGS

This invention consists in the novel parts, construction, arrangements, combinations and improvements, shown and described. The accompanying drawings, which are incorporated in and constitute a part of this specification, illustrate one embodiment of the invention and, together with a description, serve to explain the principals of the invention.

Of the drawings.

DETAILED DESCRIPTION OF THE INVENTION

Figure 1:
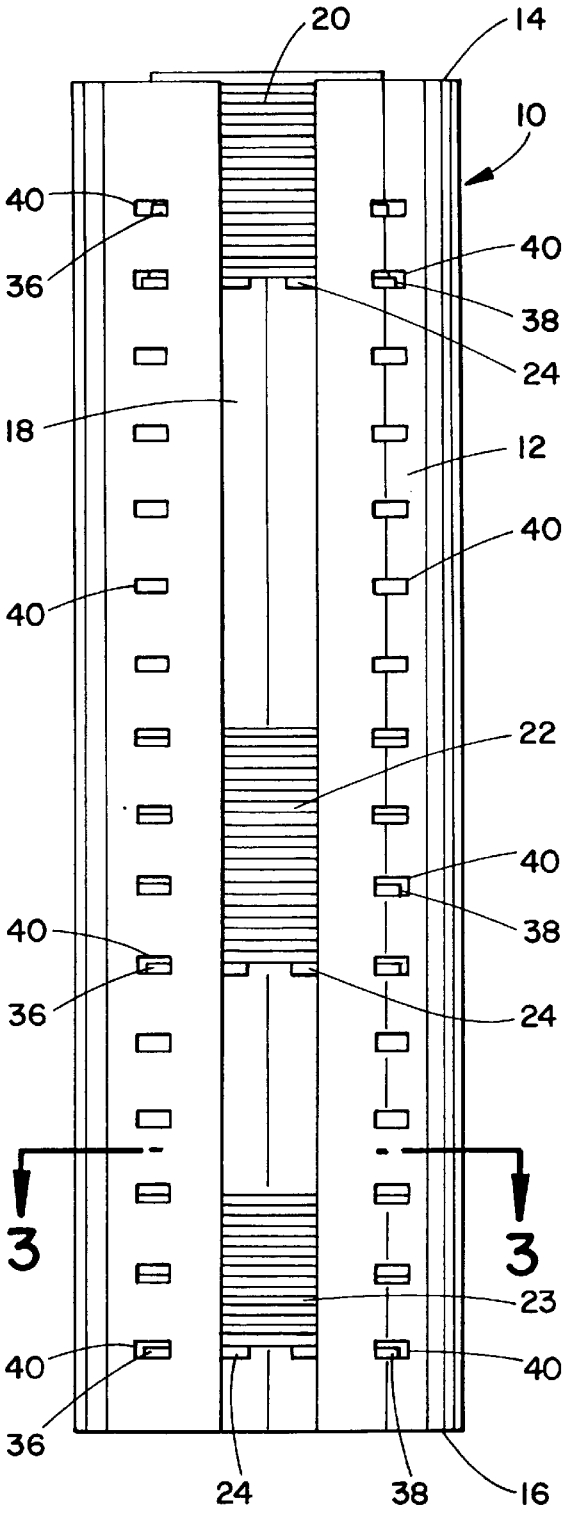
FIG. 1 is a front elevation view of the device constructed in accordance with the teachings of this invention.
Figure 2:
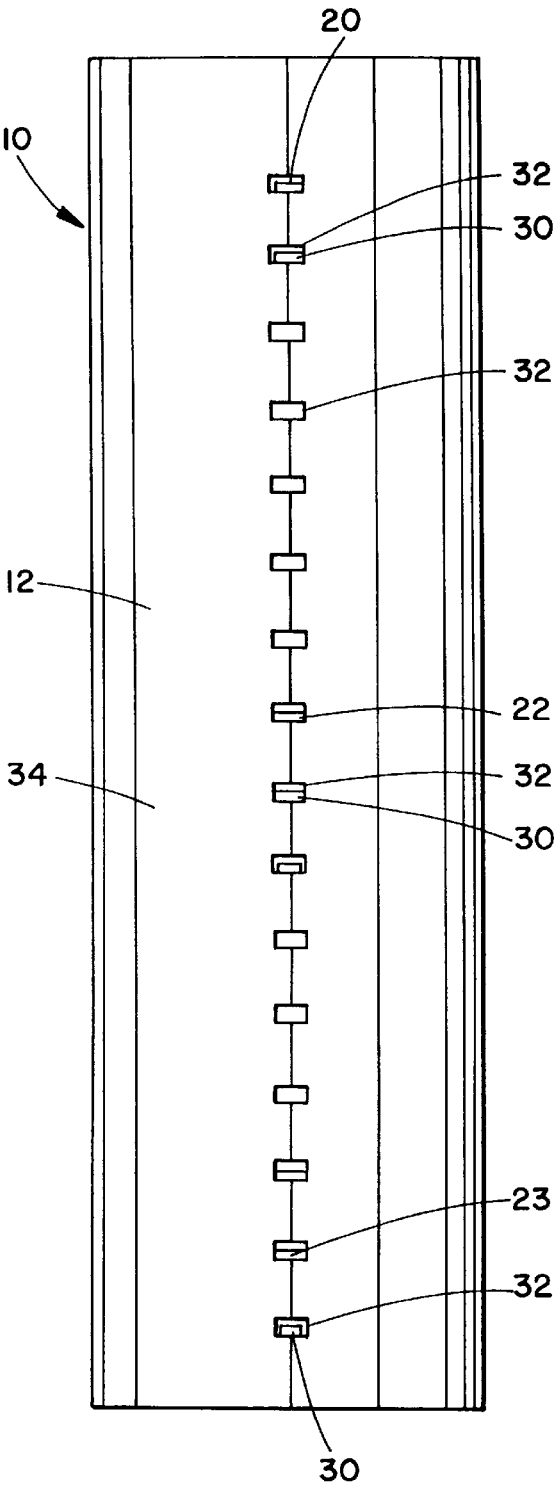
FIG. 2 is a rear view of the device of FIG. 1.
Figure 3:
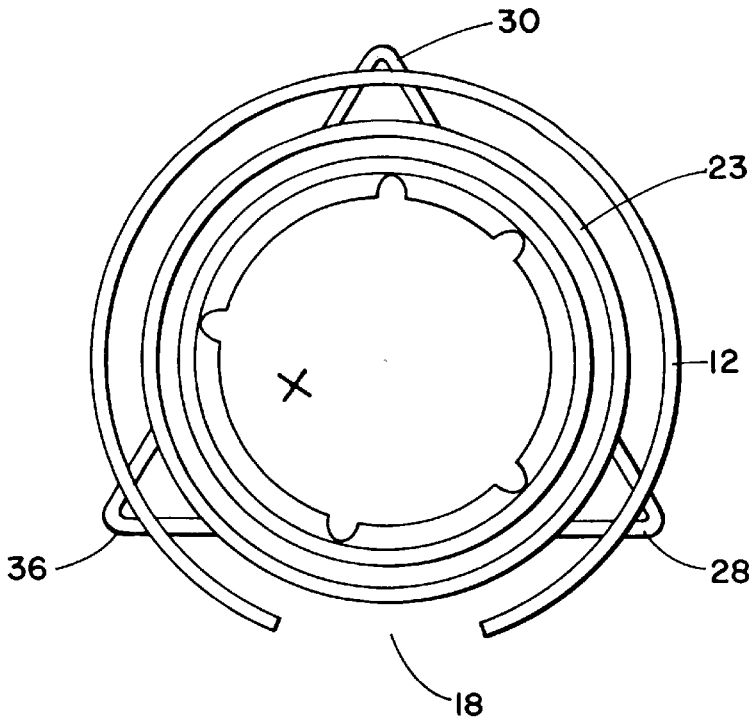
FIG. 3 is a sectional view taken along line 3—3 of FIG. 1.
Figure 4:
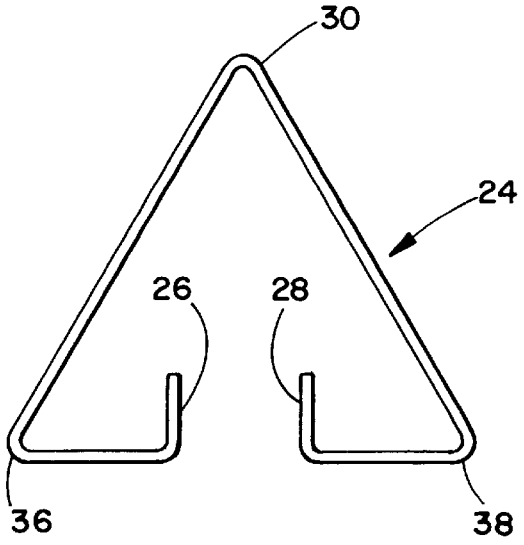
FIG. 4 is a top plan view of the removable divider of the invention.
Figure 5:
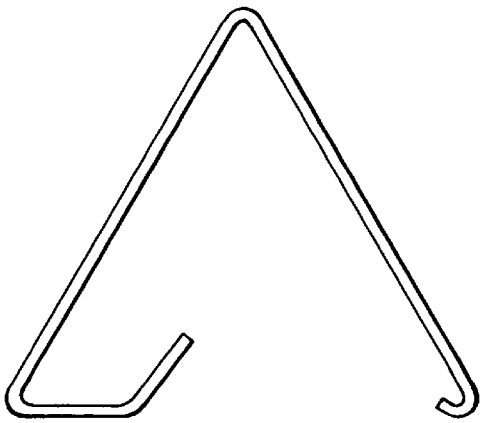
FIG. 5 is a top plan view of an alternative embodiment of the removable divider.

Reference will now be made in detail to the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications and equivalents may be included within the spirit and scope of the invention defined by the appended claims.

With reference now to FIGS. 1–4, wherein like elements are referred to with like reference numerals, the invention will be described. The inventive storage and dispensing device 10 is comprised of an elongated body 12 having an open top end 14 and a closed bottom end 16. An aperture 18 is formed along the longitudinal axis of the elongated body 12. Visible through the aperture (see FIG. 1) are three groups of stacked lids 20 (small size), 22 (medium size), and 23 (large size). The different sized lids are separated into distinct storage and dispensing areas by resilient clips 24.

Resilient clips 24 are preferably comprised of an deformable metal or plastic material which allows legs 26 and 28 (see FIG. 4) to be squeezed together, reducing the overall dimension between corners 36 and 38 and allowing removal of the clips. In a preferred form of the invention, the clip is coated with a resilient plastic material to provide an improved surface texture for gripping and to reduce sharp points. For example, each of the exposed ends of the clip in FIGS. 4, 5, 7 and 9, or in fact the entire clip, could be coated with plastic.

In assembly of the device 10, tip 30 of clip 24 is inserted into one of the plurality of notches 32 formed on the rear wall 34 of elongated body 12 while legs 26 and 28 are squeezed together. After position of tip 30, release of legs 26 and 28 allows corners 36 and 38 to expand outwardly into corresponding notches 40 on the front wall of elongated body 12. Accordingly, clip 24 can be repositioned in any of the plurality of notches formed in elongated body 12.

Figure 6:
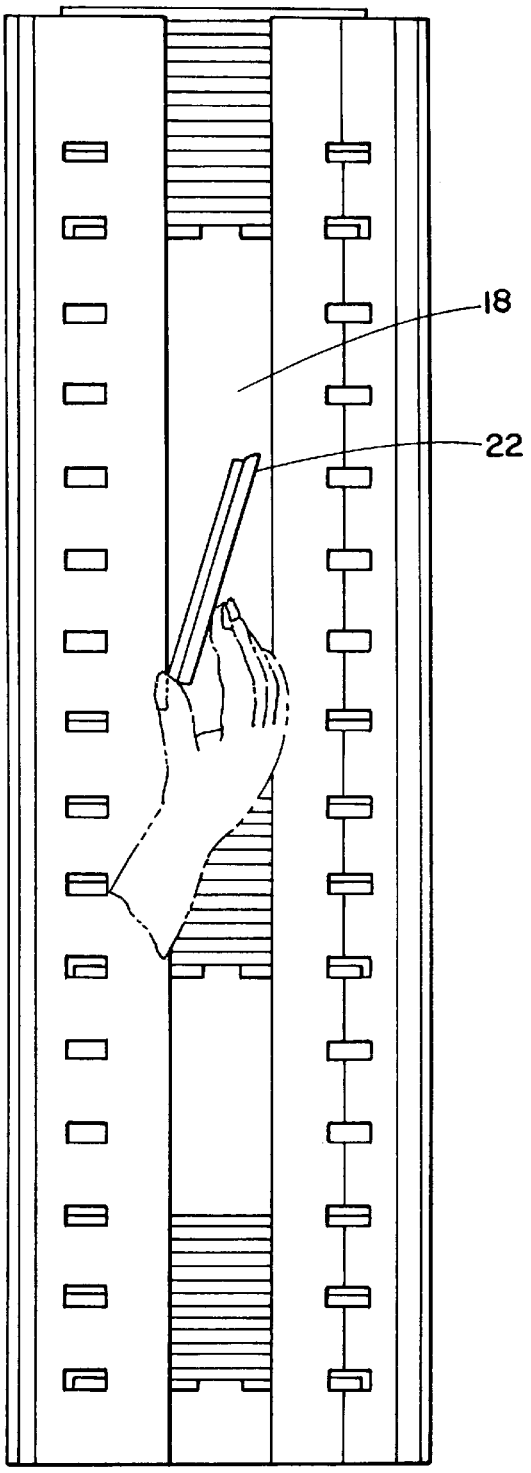
FIG. 6 is a front elevation view of the device depicting the manner in which a drink cup lid is removed.
Figure 7:
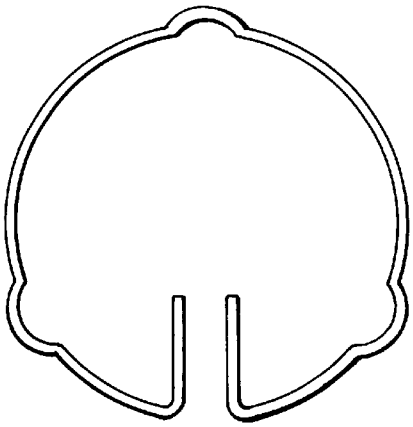
FIG. 7–9 are plan views of alternative shaped removable dividers.

FIG. 6 depicts the manner in which a lid is removed. Moreover, aperture 18 in the width of lid 22 prevents its inadvertent escape from elongated body 12 while physical manipulation of cap 22 (turning it on end) allows the cap to pass through aperture 18.

Figure 8:
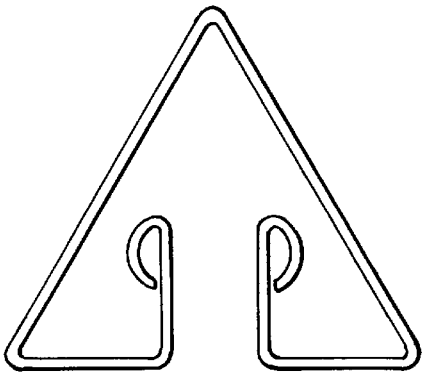
Figure 9:
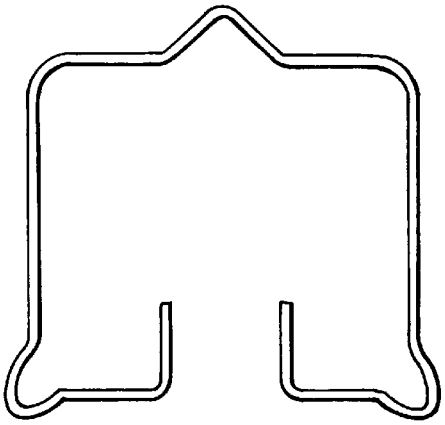

Any desired arrangement of storage areas can be prepared to accommodate required quantities of different size lids. Furthermore, although the invention is described in the context of a resilient clip mated with notches in the elongated body, it is envisioned that this invention will be equally functional with inwardly disposed ridges on inner wall of elongated body 12 upon which a clip can rest. Furthermore, it is within the scope of this invention that a high elastic material maintained under at least partial compression with a sufficient frictional engagement of the inner walls of the elongated body could act as a clip in supporting the stacked articles. Similarly, a variety of shapes would accomplish the requisite support of the clips. For example, FIG. 7 to 9 demonstrate alternative forms of dividers suited to the present invention. Of course, the divider shape is only limited by the requirement to provide an interface with the walls of the storage area.

With regard to the stacked articles, although drinking cup lids have been described, it is also envisioned that items such as compact discs, (wherein storage areas are divided by subject matter rather than size) or any article having a width and depth greater than height is particularly suited to this invention.

Thus, it is apparent that there has been provided, in accordance with the invention, a storage device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed:

1. A device for storing and dispensing a plurality of articles, said device being comprised of an elongated cylindrical body shaped to contain said plurality of articles in a stacked arrangement, said elongated body having a longitudinal axis with a predominantly vertical orientation, at least one wall of said elongated body including an aperture extending along a substantial portion of a length of said body, said aperture being sized to allow removal of at least one of said articles through said aperture, at least one removable clip being positioned inside said elongated body to provide separation of at least two groups of said articles.

2. The device of claim 1 wherein said two groups of said articles consist of a first group having a first size and a second group having a different size.

3. The device of claim 1 wherein said clip is triangular shaped.

4. The device of claim 3 wherein said clip includes a split base portion providing a flexing means for corners adjacent said base portion.

5. The device of claim 1 wherein said removable clip is comprised of a generally flat member having at least three corners and wherein said body includes a plurality of holes aligned to mate with the corners of said clip.

6. The device of claim 1 wherein said articles are drinking cup lids.

7. The device of claim 1 wherein a top portion is open to allow loading of said articles.

8. The device of claim 1 wherein said clip frictionally engages an inner wall of said elongated body.

9. The device of claim 1, wherein said clip is encased in plastic coating.

10. The device of claim 4, wherein said split base portion of said clip is encased in a plastic coating.

11. A dispenser for stacked storage of cup lids, said lids being in a group of at least two different sizes, said device comprising a vertically oriented elongated body having an open top end and a side wall including an aperture through which individual lids can be removed, said body also including a plurality of staggered slots, a flexible divider having an expanded condition wherein said divider is secured in at least one of said slots and a compressed condition wherein said divider is removable from said elongated body and moveable to an alternative at least one slot, said body being divisible into a plurality of storage chambers to allow lids of different sizes to be maintained separately in said storage device.

12. A device for storing and dispensing a plurality of articles, said device being comprised of an elongated body shaped to contain said plurality of articles in a stacked arrangement, said elongated body having a longitudinal axis with a predominantly vertical orientation, at least one wall of said elongated body including an aperture extending along a substantial portion of a length of said body, said aperture being sized to allow removal of at least one of said articles through said aperture, at least one triangular shaped removable clip being positioned inside said elongated body to provide separation of at least two groups of said articles.

13. A device for storing and dispensing a plurality of beverage lids, said device being comprised of an elongated body containing said plurality of beverage lids in a stacked arrangement, said elongated body having a longitudinal axis with a predominantly vertical orientation, at least one wall of said elongated body including an aperture extending along a substantial portion of a length of said body, said aperture being sized to allow removal of at least one of said beverage lids through said aperture, at least one removable clip being positioned inside said elongated body to provide separation of at least two groups of said beverage lids.

14. A device for storing and dispensing a plurality of articles, said device being comprised of an elongated body shaped to contain said plurality of articles in a stacked arrangement, said elongated body having a longitudinal axis with a predominantly vertical orientation, at least one wall of said elongated body including an aperture extending along a substantial portion of a length of said body, said aperture being sized to allow removal of at least one of said articles through said aperture, at least one removable generally flat clip having at least three corners being positioned inside said elongated body to provide separation of at least two groups of said articles, and said elongated body including a plurality of holes aligned to mate with corners of said clip.

15. A device for storing and dispensing a plurality of articles, said device being comprised of an elongated body shaped to contain said plurality of articles in a stacked arrangement, said elongated body having a longitudinal axis with a predominantly vertical orientation and an open top, at least one wall of said elongated body including an aperture extending along a substantial portion of a length of said body, said aperture being sized to allow removal of at least one of said articles through said aperture, at least one removable clip being positioned inside said elongated body to provide separation of at least two groups of said articles.

* * * * *